United States Patent [19]

Dahl

[11] 3,970,077

[45] July 20, 1976

[54] SUPPORT FOR PATIENTS IN BEDS OR CHAIRS

[76] Inventor: Flemming Dahl, 70 Borgervaenget, 2100 Copenhagen, Denmark

[22] Filed: Mar. 6, 1975

[21] Appl. No.: 555,730

[52] U.S. Cl. ..... 128/33
[51] Int. Cl.[2] ..... A61H 1/00
[58] Field of Search ..... 128/24 R, 33, 51, 52, 128/64

[56] References Cited

UNITED STATES PATENTS

| | | | |
|---|---|---|---|
| 2,445,158 | 7/1948 | Sparhawk | 128/33 X |
| 2,906,259 | 9/1959 | Adair | 128/33 |
| 3,467,081 | 9/1969 | Glass | 128/33 |

*Primary Examiner*—Lawrence W. Trapp
*Attorney, Agent, or Firm*—Burgess Ryan and Wayne

[57] ABSTRACT

A mechanical support, the surface of which is composed of at least two sets of interspaced surface sections, whose set level can be varied by a driving mechanism. This support can be used for persons who, for example, because of paralysis or injury must continually sit or lie and are therefore likely to get bedsores unless they are helped at regular intervals to change their sitting or lying posture.

9 Claims, 5 Drawing Figures

SUPPORT FOR PATIENTS IN BEDS OR CHAIRS

A known support of similar character described in U.S. Pat. No. 2,684,672 uses a cushion-like device of flexible material, divided into a number of airtight compartments or cells which run from the upper to the lower surface of the support.

These cells are divided into two sets and the cells in each set are joined to each other and to pneumatic controller which alternately pumps up one set while deflating the other.

The result being that the surface of one set rises while the surface of the other set falls.

This produces a varying support for the person using the device and at the same time achieves a massaging effect which according to this known patent should reduce the risk of bedsores.

However, this method is both complicated and expensive because of the special cell construction of the cushion, and the pneumatic controller which must inflate one set of cells while at the same time deflates the other and then deflate the first set while inflating the second.

Moreover, it is not suitable for paralyzed or sick persons who must lie or sit motionless because its surface is never at rest as when one set of cells is being inflated, the other is being deflated and the patient rests upon the first set which in practice determines the height of the support surface. Afterwards, when this first set is being deflated, the other set is being inflated which causes the surface of the first set to fall while the surface of the second rises and theoretically they meet half way when they are mid way between the fully inflated and the fully deflated condition. Thereafter it is the second set which determines the surface height of the support as a whole.

The patient using this known support will then continually be moved up and down between the full and half height of the surface of the cells unless the support is made of a very flexible material which can introduce a degree of evening out of the upper surface height variations. If the material is too flexible, the effectiveness of the support will suffer because the purpose was to reduce the risk of bedsores by varying the areas of support for the patient's body.

There is also the likelihood that the cell walls, and where they are joined to the support surface, will be felt by the patient as continual pressure areas and thus further the risk of bedsores.

The contruction of this known support must then be a compromise between a support with a reasonably constant surface level and the maximum variation of surface areas upon which the patient is supported.

The mechanical support described in this patent is notable, in that, one set of surface sections, during an operation cycle, moves from a common starting level to a lower level and then back to the original starting level after which the next set of sections moves to a lower level and then back again to the original starting level to complete the cycle of operation.

This design principle makes possible the use of simple blocks or bars for the individual surface sections, as no level variations are noticable by the user because he or she will always be supported by the sections at the common starting level and at least one set of sections will always be at this level.

Only after another section has been raised to this level, will the first section begin to sink to a lower level, thereby completing the transfer of support to another area of the user's body.

The patient is not aware of the level variations but with each complete transfer of support, the circulation is restored in the last supported area and bedsores are avoided.

The invention makes possible a form of construction where the surface sections are made of independent elements such as lengthwise or lateral bars or rectangular blocks placed right up to each other, thereby avoiding uncomfortable stationary surface areas.

A mechanical support as described in this invention can be built both easily and inexpensively.

Each set is a frame which holds its own surface sections and can be driven independently by its own cams, the cams being driven by a small battery powered motor.

The driving unit can be so light and compact that it can, together with a motorcycle battery, be fitted in an ordinary wheelchair.

Hereunder, is a description of this invention on the basis of several possible constructions with reference to the accompanying drawings.

Figure 1:
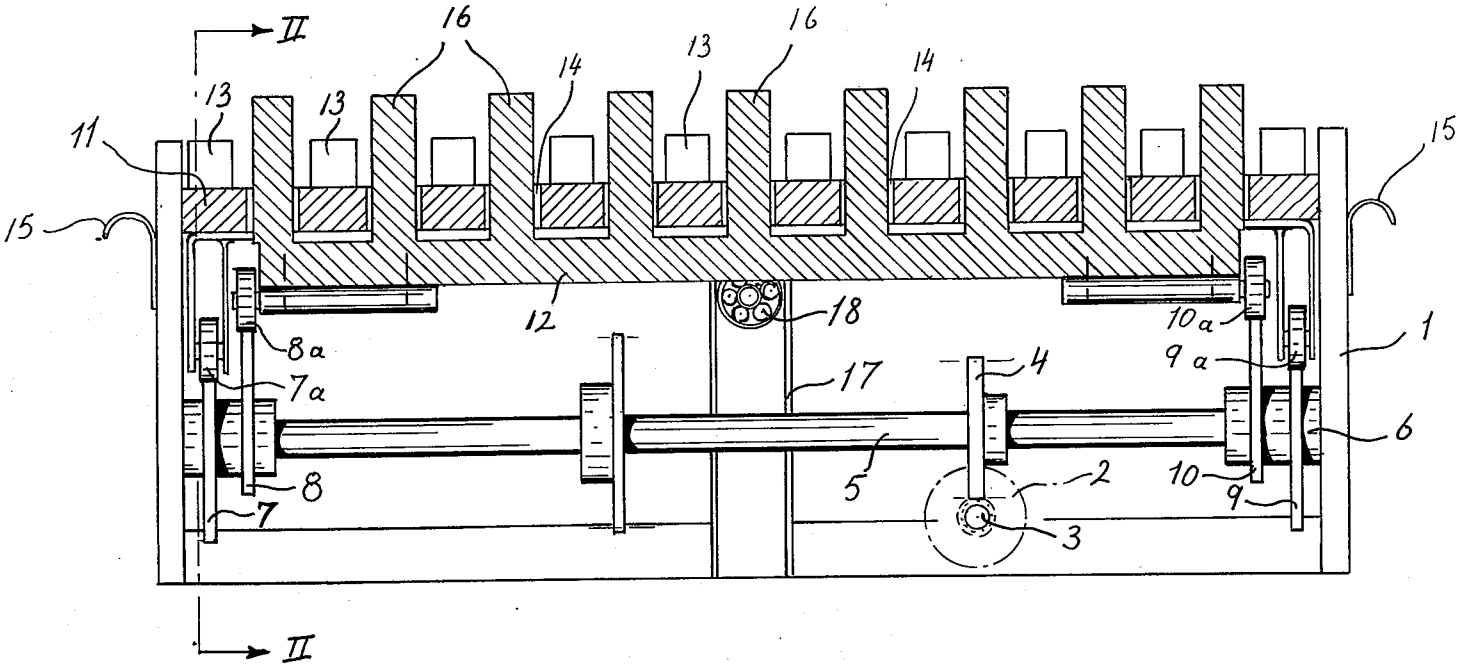
FIG. 1 shows a section of the support, according to the invention, in the form of a seat whose surface is made up of vertically moveable blocks.

In FIG. 1 is shown a seat 1 inside of which is a motor 2, preferably an electric motor, whose axle 3 is a wormscrew which, through wormwheel 4, drives an axle 5 which runs in bearings 6 housed in the seat's chassis.

Figure 2:
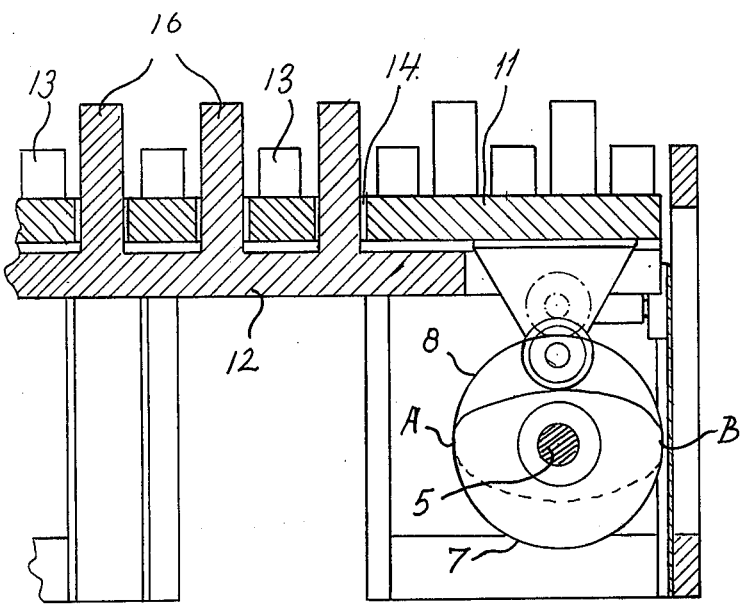
FIG. 2 is a section along line 11—11 of the seat shown in FIG. 1.

At both ends of axle 5 are mounted identical cams 7, 8 and 9, 10 as seen in FIG. 1, and shown in more detail in FIG. 2.

Cams 7, 8 are displaced 180° from each other as are cams 9, 10. FIG. 2 shows only cams 7, 8 but as seen in FIG. 1 cams 9, 10 are also mounted on the same axle 5. It can be seen from FIG. 2, that the identical, though displaced 180°, cams 7, 8 each have a circular contour which has been recessed over a segment of just under 180°, the contour of this recessed section is not critical providing it at no point projects as far as the radius of the semicircular projecting half of the cam. The angular displacement between adjacent cams A and B provide areas where they overlap as both concurrently project full cam radius from axle 5.

Cams 8 and 10 control the level of the lower frame through ball bearings 8*a* and 10*a*, on axles fitted to this frame, and cams 7 and 9 control the level of the upper frame through ball bearings 7*a* and 9*a*, housed under this frame.

The upper frame 11 supports a number of cylindrical blocks 13 which are interspaced over the whole surface of the seat 1 and between which are bored holes 14 through the frame to take up the similar though higher blocks 16 which are supported by lower frame 12 as shown in FIG. 1.

Here, blocks 13 on the upper frame 11, which form one set of the seat's surface sections are shown in their lower position where they are no longer the active supporting elements. In other words the recessed sections of cams 7 and 9 which control the level of blocks 13 are in contact with bearings 7*a* and 9*a*. Blocks 16 on the lower frame 12 which form the seat's second set of surface sections are therefore at their upper level, where they form the active support area for the seat's user. In other words, the semicircular projecting faces of cams 8 and 10 are in contact with bearings 8*a* and 10*a*.

From FIGS. 1 and 2, it can be seen that if axle 5 with cams 7, 8, 9 and 10, turns through 90° from the position shown in the drawings, the equally projecting parts of cams 7, 8, 9 and 10 at A and B in FIG. 2, will all be in contact with their respective bearings 7*a*, 8*a*, 9*a* and 10*a*, so that both blocks 13 and blocks 16 will be in the upper position, where both sets are active in supporting the patient.

After a further 90° of rotation of axle 5, say clockwise as seen in FIG. 2, the ball bearings 8*a* and 10*a* on frame 12 with its blocks 16, which were in the active position, will now be in contact with the recessed section of the cam profile of cams 8 and 10, so that these blocks 16 will now be lowered to the inactive position. Ball bearings 7*a* and 9*a* on frame 11 with blocks 13, which were in the inactive lowered position until after the 90° of axle 5 rotation, when they were lifted to the upper, active position, remain in contact with the projecting section of cams 7 and 9, and therefore remain in the upper active position where they are now the sole supporting elements for the patient's body.

For most of the next 90° of axle 5 rotation, this situation will remain unchanged because bearings 7*a* and 9*a*, which support frame 11 with the now active blocks 13, are still in contact with the projecting sections of cams 7 and 9, while the now inactive blocks 16's bearings 8*a* and 10*a* rest on the recessed sections of cams 8 and 10.

Just before the end of this 90° of axle 5 rotation, the bearings 8*a* and 10*a* of the inactive blocks 16, rest on the cam section immediately before areas A and B of cams 8 and 10, where the contour begins to rise, lifting blocks 16. When this 90° is completed, the bearings 7*a*, 8*a*, 9*a* and 10*a* will again all rest on areas A and B of cams 7, 8, 9 and 10, so that blocks 13 and 16 are now at the same level. In other words, in the upper active position.

Further rotation of axle 5 will cause blocks 13, in a similar manner to that just described, to sink from the active position to a lower inactive level, blocks 16 which have just come up to the active position will remain in this active position for the next 180° of axle 5 rotation, their bearings resting on the semicircular section of their cams 8 and 10. After this all blocks will again come to the same level, as overlapping areas A and B again become effective and then their relative positions will again change so that blocks 16 again become the active support and blocks 13 assume the inactive role.

From the foregoing, it can be seen that the construction, according to this invention, achieves, for a continually sitting or lying person, a means of support which eliminates the risk of bedsores because the area of the body which is in contact with the support is being continually changed.

Axle 5 need not be rotated continually but can easily be made to rotate periodically, for example by using a motor 2 which turns axle 5 a half rotation every fifth or tenth minute.

Motor 2 can, by suitable choice of gearing such as a wormscrew and wormwheel 3 and 4, be quite small so that the complete seat can, without difficulty, be fitted in an ordinary wheelchair or into a seat in an automobile.

In FIG. 1, are shown hooks 15 with which the seat can be fastened to a wheelchair seatframe.

FIG. 1 shows cams 7 and 8 at one side and cams 9 and 10 at the other, but to ensure purely vertical movement of frames 11 and 12 with blocks 13 and 16, two more cam pairs must be used so that there is preferably one pair of cams at each corner of the seat.

There are also vertical guides for frames 11 and 12. Such guides can be made in several different ways, for example, as U-shaped rails 17, in which the ball bearings 18 of frames 11 and 12 run, as shown in FIG. 1.

It is advantageous to use such guides on each of the seat's side walls.

Figure 3:
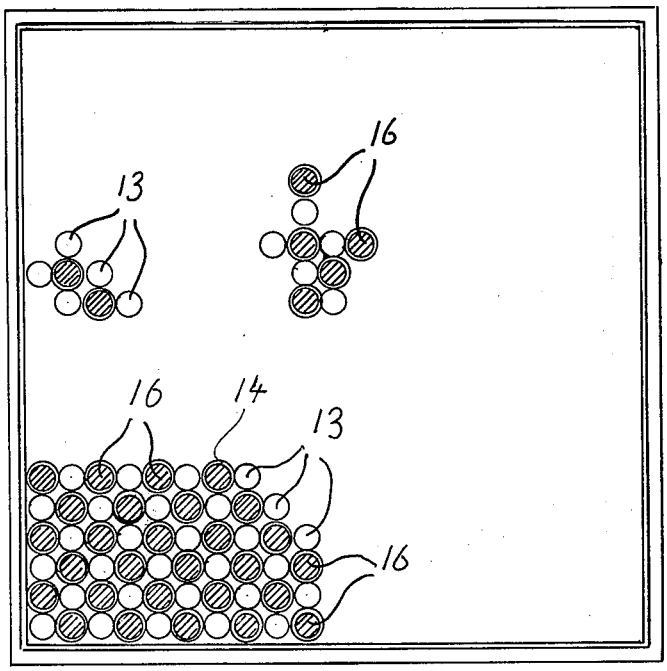
FIG. 3 is the seat shown in FIG. 1 as seen from above.

FIG. 3 shows a seat of the foregoing construction, but shows only some of blocks 13 and 16, which are interspaced in the same way over the whole surface of the seat.

Instead of using vertically moving blocks, lengthwise or lateral bars may be employed to achieve the same effect; these cover respectively the seat's length or breadth and are alternately driven by one or other of two driving devices, which, like those driving frames 11 and 12, are displaced from each other.

Cams such as 7, 8, 9 and 10 in FIG. 1, can be used.

Figure 4:
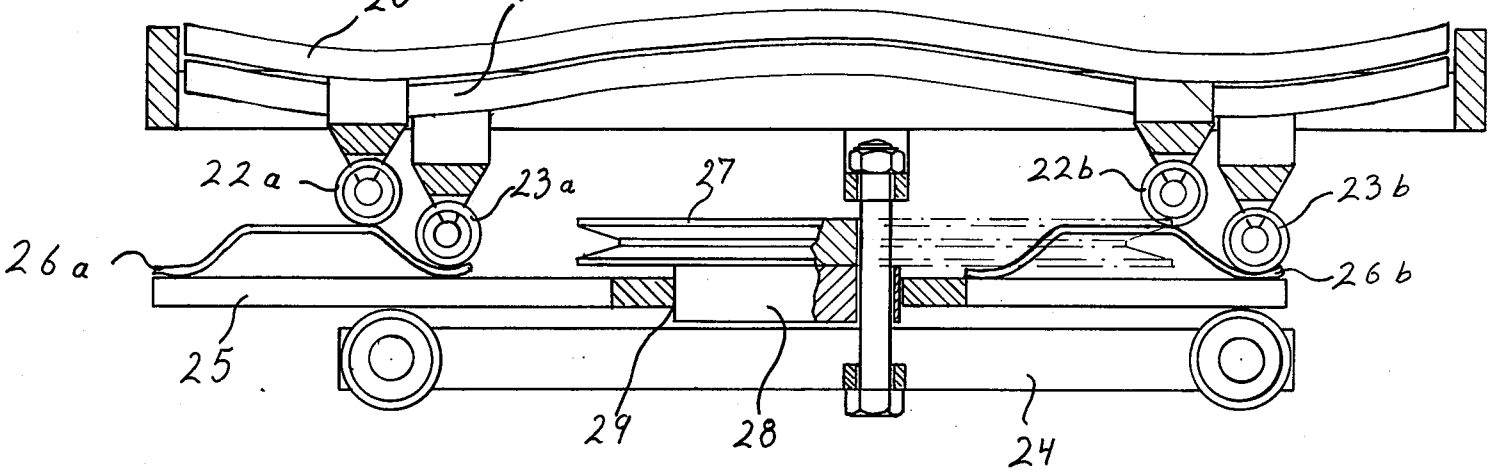
FIG. 4 is a section of another construction form for this invention.
Figure 5:
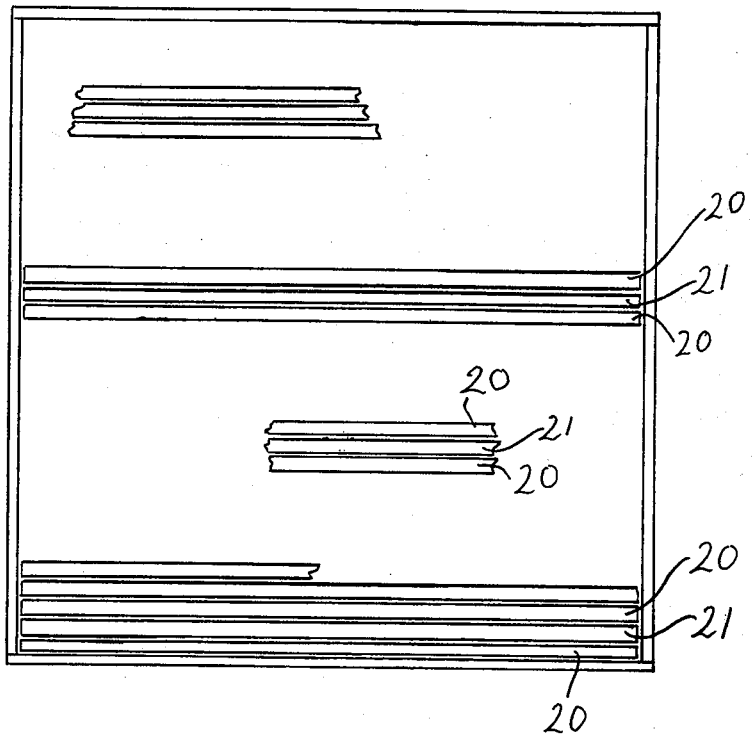
FIG. 5 is a partial top plan view of the form shown in FIG. 4.

FIG. 4 shows a mechanical support design, according to this invention, where the surface is made up of a number of parallel bars 20 and 21, of which only two are shown here, and as can be seen, they are contoured so as to provide maximum comfort for a seated person.

Bars 20 and 21 rest on their respective rollers 22*a*, 22*b*, and 23*a*, 23*b*; these rollers ride on a table which can be driven forward and back, parallel to bars 20 and 21, on base plate 24.

On this moveable table 25, are built raised up sections 26*a* and 26*b*.

The length of the flat tops of these raised up sections is equal to or greater than the distance between rollers 22*a* and 23*a* and between 22*b* and 23*b*.

The distance between sections 26*a* and 26*b* is the same as the distance between roller pairs 22*a*, 23*a* and 22*b*, 23*b*.

A driving mechanism is mounted on base plate 24, shown schematically in FIG. 4, which drives table 25 forward and back.

It can be seen that if table 25 is in the position shown, then bars 20 will be raised to a maximum height and are therefore the active supporting elements because their rollers 22*a* and 22*b* are now on the flat tops of the raised up sections 26*a* and 26*b*.

When table 25 moves further right, rollers 23*a* and 23*b* will run onto the flat tops of the table's raised up sections so that bars 20 and 21 will now be at the same level.

As table 25 continues to move to the right, rollers 22*a* and 22*b* run down from the raised up sections leaving bars 21 as the active supporting bars and lowering bars 20.

At this stage, the direction of table movement is reversed and rollers 22*a* and 22*b* again run up onto the raised up sections so that bars 20 again come up to the active supporting position as are bars 21, and as the leftward movement of table 25 continues, rollers 23*a* and 23*b* run down from the raised up sections 26*a* and 26*b* so that bars 20 alone are the supporting elements for the patient as shown in FIG. 4.

It can be seen that, again with this construction of the invention, a simple inexpensive mechanical support can be produced which allows a continually sitting or lying person, continually or intermittently, as desired, change of supporting area, without his being aware of the changes taking place because the level of the active supports is always the same.

The driving mechanism for the form of construction shown in FIG. 4, consists of a disc 27, driven by a small battery powered motor, whose eccentric projection 28 runs in a groove 29 in table 25.

Thus the support can function without dependence upon any other energy source.

What I claim is:

1. A mechanical support for a bed or chair for eliminating bed sores, comprising at least two sets of vertically displaceable support members having rigid upper surfaces defining a contour of a human body, a separate cam follower attached to each set of support members for simultaneously vertically displacing all the support members of the set of support members attached thereto, a cam contacting each cam follower and movable with respect to each cam follower, said cam having raised surfaces concurrently contacting said cam followers attached to at least two of said sets of support members and having lower surfaces noncurrently contacting said cam followers, and a motor connected to said cam for moving said cam with respect to said cam followers, said cam followers thereby raising said sets of support members to an upper position wherein they reside concurrently and lowering said sets of support members separately.

2. A mechanical support as recited in claim 1, wherein said support members comprise rigid parallel bars, each of said bars having an upper surface defining a contour of a portion of a human body, each bar of a first set of said support members being separated from other bars of said first set of said support members by a bar of a second set of said support members.

3. A mechanical support as recited in claim 2, wherein said cam is rotated by said motor and comprises two substantially symmetrical cam portions, each of said cam portions having a substantially circular upper surface concentric with the axis of rotation thereof and encompassing an angle greater than 180° and having a lower surface, said lower surface of said two cam portions being opposed.

4. A mechanical support as recited in claim 1, wherein each of said sets of support members comprises a plurality of axially displaceable parallel rods, the ends of all of said support members being arranged in the form of a matrix wherein each rod of a first group of support members is spaced from another rod of said first group of support members by a rod of a second group of said support members.

5. A mechanical support as recited in claim 4, wherein said cam is rotated by said motor and comprises two substantially symmetrical cam portions, each of said cam portions having a substantially circular upper surface concentric with the axis of rotation thereof and encompassing an angle greater than 180° and a lower surface, said lower surface of said two cam portions being opposed.

6. A mechanical support as recited in claim 1, wherein said cam is rotated by said motor and comprises two substantially symmetrical cam portions, each of said cam portions having a substantially circular upper surface concentric with the axis rotation thereof and encompassing an angle greater than 180° and having a lower surface, said lower surface of said two cam portions being opposed.

7. A mechanical support as recited in claim 1, wherein said cam is reciprocally movable in a predetermined direction, wherein said cam followers are spaced along said predetermined direction, wherein said motor comprises means for reciprocally moving said cam, and wherein the amplitude of the reciprocal motion is equal to the sum of the distance between said cam followers in said predetermined direction and the distance across the raised surface of said cam in said predetermined direction.

8. A mechanical support as recited in claim 2, wherein said cam is reciprocally movable in a predetermined direction, wherein said cam followers are spaced along said predetermined direction, wherein said motor comprises means for reciprocally moving said cam, and wherein the amplitude of said reciprocal motion is equal to the sum of the distance between said cam followers in said predetermined direction and the distance across the raised surface of said cam in said predetermined direction.

9. A mechanical support as recited in claim 4, wherein said cam is reciprocally movable in a predetermined direction, wherein said cam followers are spaced along said predetermined direction, wherein said motor comprises means for reciprocally moving said cam, and wherein the amplitude of said reciprocal motion is equal to the sum of the distance between said cam followers in said predetermined direction and the distance across the raised surface of said cam in said predetermined direction.

* * * * *

UNITED STATES PATENT OFFICE

CERTIFICATE OF CORRECTION

Patent No. 3,970,077 Dated July 20, 1976

Inventor(s) Flemming Dahl

It is certified that error appears in the above-identified patent and that said Letters Patent are hereby corrected as shown below:

Column 1, line 10: After "and to" insert --a--.

line 22: "deflates" should be --deflating--.

line 44: After "If" insert --, however,--.

line 65: "noticable" should be --noticeable--.

Signed and Sealed this

Twenty-third Day of November 1976

[SEAL]

*Attest:*

RUTH C. MASON
*Attesting Officer*

C. MARSHALL DANN
*Commissioner of Patents and Trademarks*

UNITED STATES PATENT OFFICE

CERTIFICATE OF CORRECTION

Patent No. 3,970,077 Dated July 20, 1976

Inventor(s) Flemming Dahl

It is certified that error appears in the above-identified patent and that said Letters Patent are hereby corrected as shown below:

Column 6, line 18 (claim 6, line 5): After "axis" add --of--.

Signed and Sealed this

First Day of March 1977

[SEAL]

*Attest:*

RUTH C. MASON
*Attesting Officer*

C. MARSHALL DANN
*Commissioner of Patents and Trademarks*